US005897261A

United States Patent [19]

Goetz

[11] Patent Number: 5,897,261

[45] Date of Patent: Apr. 27, 1999

[54] BALLPOINT PEN FOR CREDIT CARD RECEIVING POCKET

[76] Inventor: Lawrence Goetz, 3263 Bedford Ave., Brooklyn, N.Y. 11210

[21] Appl. No.: 08/308,711

[22] Filed: Sep. 19, 1994

[51] Int. Cl.[6] ..... B43K 7/00; B43K 9/00

[52] U.S. Cl. ..... 401/6; 401/209; D19/41; D19/43; D19/45

[58] Field of Search ..... 401/6, 209; D19/43, D19/41, 45

[56] References Cited

U.S. PATENT DOCUMENTS

| | | | |
|---|---|---|---|
| D. 195,924 | 8/1963 | Perlmutter | D19/45 |
| D. 207,563 | 5/1967 | Bailey, Jr. | D19/45 |
| D. 276,479 | 11/1984 | Mori | 401/6 X |
| D. 302,985 | 8/1989 | Vinck | 401/6 X |
| D. 322,811 | 12/1991 | Isern | D19/36 |
| D. 324,879 | 3/1992 | Morgan | D19/36 |
| D. 329,458 | 9/1992 | Ellis | 401/209 X |
| 3,168,072 | 2/1965 | Nitta | 401/6 X |
| 3,994,605 | 11/1976 | McKnight | 401/6 X |
| 4,568,213 | 2/1986 | Money | 401/6 |
| 4,732,504 | 3/1988 | Telli | 401/209 |
| 4,815,880 | 3/1989 | Sekiguchi | 401/6 |

FOREIGN PATENT DOCUMENTS

| | | | |
|---|---|---|---|
| 749690 | 1/1967 | Canada | 401/6 |
| 2431377 | 3/1980 | France | 401/6 |
| 170706 | 2/1905 | Germany | 401/6 |

*Primary Examiner*—Steven A. Bratlie
*Attorney, Agent, or Firm*—Robert W. J. Usher

[57] ABSTRACT

A ballpoint pen with cap has an overall length which is substantially equal to a conventional credit card enabling the pen to fit snugly in a credit card receiving pocket of a pocket book. The pen has a thin, flat body containing a writing cartridge and having opposite side edges diverging rearward in plan from a front writing end to provide a broad, flat, blade-like, hand engaging rear portion. The body also tapers in thickness as it extends outward to opposite side and rear edges forming a narrow, peripheral insertion edge. The rear end is straight and the cap is rectangular so that, when assembled, opposite ends of the pen have straight edges extending substantially perpendicularly to a longitudinal axis of the body. The body has a lateral supporting and guiding lobe for engagement with a writer's hand in different positions to facilitate a fluid writing action with different pen grips.

3 Claims, 2 Drawing Sheets

FIG. 5
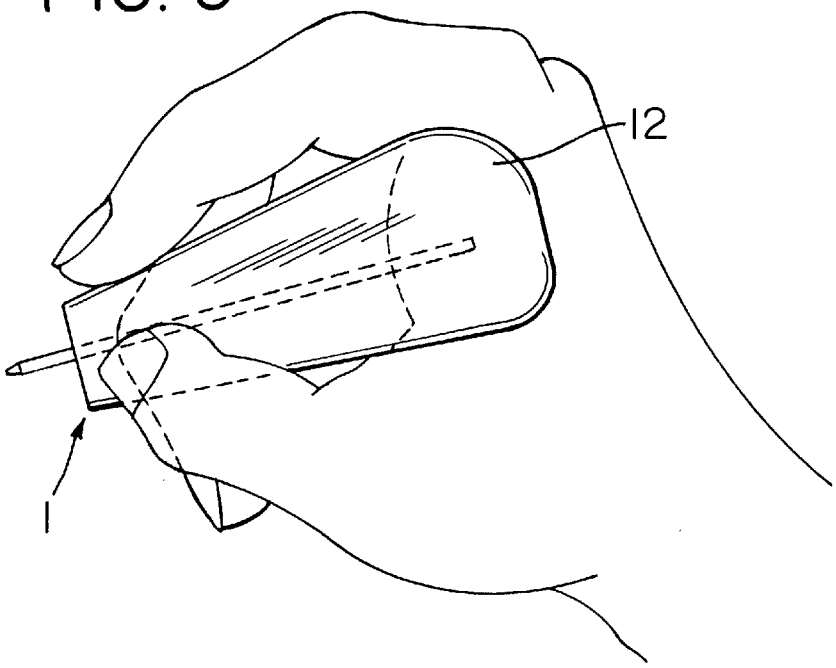
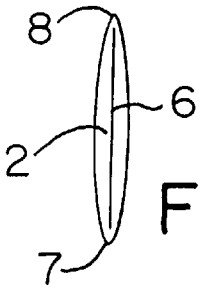
FIG. 4
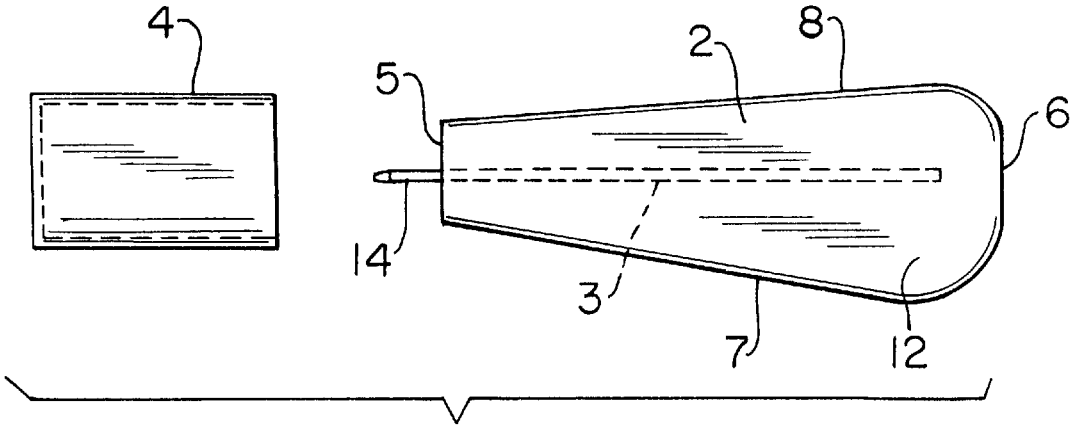
FIG. 3

BALLPOINT PEN FOR CREDIT CARD RECEIVING POCKET

FIELD OF THE INVENTION

The invention relates to a ballpoint pen which fits inside a typical credit card receiving pocket of a wallet or pocket-book.

BACKGROUND OF THE INVENTION

The need for a pen which is convenient to carry on the person and is unlikely to be forgotten so as to be available for casual use is well recognized.

The majority of ballpoint pens for everyday use have traditionally included a rigid, round or prismatic body and are commonly approximately six inches in length so as to require retention in the relatively protected environment of a pocket of an upper garment, such as the breast pocket of a jacket or shirt.

However, when changing their clothing people often forget pens when transferring other essential accessories such as pocketbooks containing credit cards, driver licenses and other essentials, particularly when continuous use of a pen is not required.

U.S. Pat. No. 4,815,880 issued to Sekiguchi in 1989, teaches a writing set in which two small writing instruments are stored in a flat, rectangular case having the perimetrical dimensions similar to those of a credit or business card for storage in a credit card receiving pocket of a pocket-book. However, the instruments must be removed from the case for use which can require some manual dexterity in view of their small size and close fit, also requiring the use of both hands with several items to manage, altogether an undesirably fiddly and time consuming operation. The multipart construction is inherently expensive, while the necessity of always carrying the case to protect the exposed pen tips and a pocket from damage results in an undesirably heavy and bulky structure.

Furthermore, the case has a blunt, square edge which is 2 or 3 mm thick preventing easy insertion by parting a closed mouth of a credit card receiving pocket or slipping between credit cards, which is inconvenient and frustrating and can easily result in strain of the pocket mouth.

U.S. Pat. No. 4,732,504, issued 1988 to Telli, teaches a ballpoint pen with a generally flat and essentially flexible outer body so that it may be carried in a back pocket of a pant/trouser type garment without breakage.

However, the essentially flexible property of the pen would often cause a leading edge to crumple or fold back on itself also preventing easy insertion in a closed mouth of a credit card receiving pocket or insertion between credit cards therein. Furthermore, pens with flexible bodies can be difficult to grip for satisfactory writing control.

U.S. Pat. No. 4,568,213 teaches a structure which is foldable from a flat form usable as a bookmark to a triangulate form for use as a pen, evidently of conventional length, and U.S. Pat. Nos. 322,811 and 324,879 issued both teach combination pen and bookmarkers. However, none of these prior taught structures are suitable for or suggestive of the purpose of the present invention.

Accordingly, there remains a need for a ballpoint pen which is adapted for direct storage in a credit card receiving pocket of a wallet and which is available for direct use and of simple construction, adapted manufacture using conventional mass production techniques for high volume production at low cost.

SUMMARY OF THE INVENTION

An object of the invention is to provide a pen which is adapted for receipt in a credit card receiving pocket of a wallet so as to be available for immediate use when removed therefrom.

An additional object of the invention is to provide a pen which is of simple construction, adapted for manufacture using conventional mass production techniques for high volume production at low cost.

A further object of the invention is to provide a ballpoint pen which facilitates alternative grips and a fluid writing action.

According to one aspect of the invention, a ballpoint pen comprises a one-piece plastic body containing a writing cartridge and a plastic cap, the body being thin, elongate and substantially rigid, having front, writing and rear ends joined by respective, rearward diverging opposite side edges so as to provide a broad, flat, blade-like, hand engaging rear portion and the body tapering in thickness as it extends outward to opposite side and rear edges forming a narrow, peripheral insertion edge, so that, with the cap assembled on the front end, the pen has an overall length which is substantially equal to a conventional credit card enabling the pen to fit snugly in a credit card receiving pocket of a pocket book.

Preferably, the rear end is straight and the cap is rectangular so that when the cap is assembled on the front end, opposite ends of the pen have straight edges which extend substantially perpendicularly to a longitudinal axis of the body.

This obviates the risk of the pen "camming out" of the pocket as would arise if one or both ends were rounded.

More specifically, the side edges are straight for a majority of their lengths and are equidistant from the longitudinal axis at the front end, one side edge having a greater divergence than the other side edge and curving gently inward to join the rear end to provide a lateral supporting and guiding lobe so that, with one pen grip, the lobe rests inclined to the vertical on a side of an index finger knuckle providing a smooth supporting control surface, and in an alternative pen grip, the lobe is substantially vertical with the curving edge thereof forming a smooth sliding engagement with the portion of the hand between knuckles of the index finger and thumb facilitating smooth longitudinal reciprocation of the pen.

BRIEF DESCRIPTION OF THE DRAWINGS

An embodiment of ballpoint pen according to the invention will now be described by way of example only and with reference to the accompanying drawings in which:

FIG. 3 is a plan view with the cap and body exploded apart;

FIG. 4 is an elevational view of the rear end of the pen body;

FIG. 5 is a perspective view of the ballpoint pen held in one writing position; and, FIG. 6 is a perspective view of the ballpoint pen held in an alternative writing position.

DESCRIPTION OF PREFERRED EMBODIMENT

Figure 6:
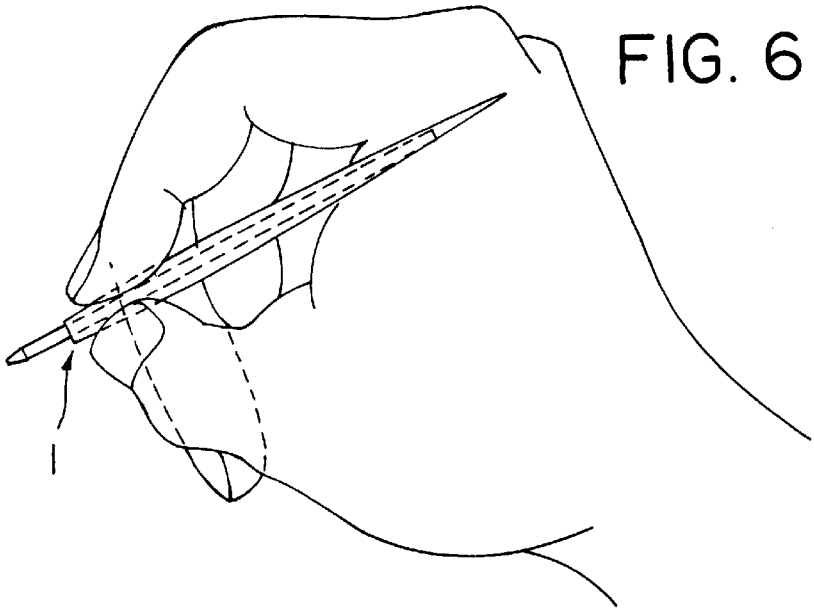
Figure 1:
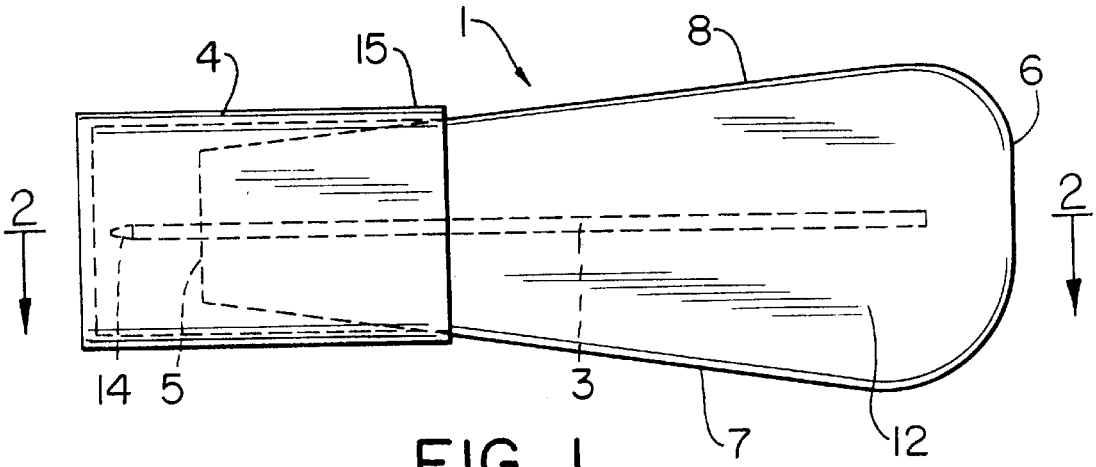
FIG. 1 is a plan view of the ballpoint pen.
Figure 2:
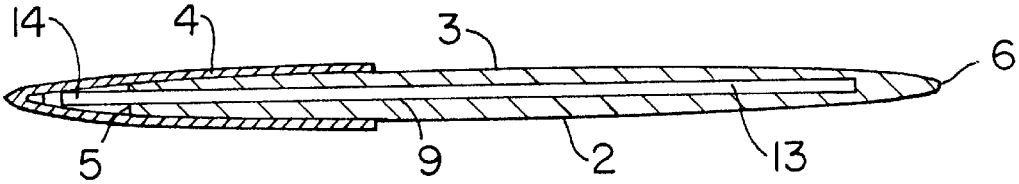
FIG. 2 is a cross-sectional view taken along lines 2–5 of FIG. 1.

The ballpoint pen 1 comprises a one-piece plastic body 2 containing a writing cartridge 3 and a plastic cap 4.

The pen body 1 is thin, elongate and substantially rigid, having front, writing and rear ends 5 and 6, respectively, joined by divergent opposite side edges 7 and 8, respectively, so as to provide a broad, flat, blade-like or spatulate, hand engaging rear portion. An ink tube receiving bore 9 extends rearward from the front end 5, along a substantially central longitudinal axis, to a location adjacent and spaced from the rear end 6. The body tapers in thickness as it extends outward from the bore to opposite sides 7 and 8 and to the rear end 6, forming a narrow or relatively sharp peripheral insertion edge. The front and rear ends have straight edges which extend substantially perpendicularly to the longitudinal axis. The side edges are straight for a majority of their lengths and are equidistant from the axis at the front end but one side edge 7 has a greater divergence than the other 8 and curves gently inward to join the rear end to provide a lateral pen supporting, hand engaging lobe 12.

The writing cartridge 3 is of conventional design having a tubular plastic ink reservoir 13 connected to a ballpoint tip 14.

The cap 4 is rectangular in plan and has a thin, flexible skirt 15 so that it can grip the forward portion of the pen for retention thereon when the pen is not in use.

In manufacture of the pen, the body can be injection molded in one piece and the ink tube subsequently inserted and retained in the bore thereof by adhesive.

The relatively broad, blade like part of the body facilitates handling and provides smooth control surfaces which facilitate insertion and writing. In particular, the pen is adapted to facilitate comfort and writing control while accommodating different natural writing grips used by different people.

When the writing grip shown in FIG. 5, in which an index finger of the writer's hand normally engages a side edge, the pen body is positioned with the larger supporting lobe 12 resting substantially horizontally on the side of the index finger knuckle providing a smooth supporting control surface permitting good pen control in spite of the small size. In an alternative writing grip, shown in FIG. 6, the index finger and thumb grip between them the respective opposite faces of the pen body with the pen in a near vertical position. Here, the gently curving control surface of the lobe is lowermost ensuring a smooth sliding engagement with the portion of the hand between knuckles of the index finger and thumb facilitating smooth longitudinal reciprocation of the pen and therefore fluid writing action.

Thus, the difficulties in writing fluidly with short pens which can sometimes arise as a result of the rear end tending to catch in the portion of the hand between the knuckles of the index finger and thumb, preventing smooth longitudinal reciprocation of the pen body, can be obviated.

I claim:

1. A ballpoint pen comprising an elongate, one-piece plastic body containing an elongate writing cartridge extending along a substantially central location thereof and, a plastic cap, the body being thin, and substantially rigid, having front, writing and rear longitudinal ends joined by respective, rearward diverging opposite side edges which diverge for a majority of an entire length of the body so as to provide a broad, flat, blade-like, hand engaging rear portion and the body tapering in thickness as it extends outward to opposite side and rear edges forming a narrow, peripheral insertion edge, the pen having an overall length, with the cap assembled, which is substantially equal to a conventional credit card, enabling the pen to fit snugly in a credit card receiving pocket of a pocket book, the side edges being straight for a majority of their lengths and being equidistant from a longitudinal axis at the front end, one side edge having a greater divergence than the other side edge and curving gently inward to join the rear end to provide a lateral supporting and guiding lobe so that, with one pen grip, the lobe rests inclined to the vertical on a side of an index finger knuckle providing a smooth supporting control surface, and in an alternative pen grip, the lobe is substantially vertical with the curving edge thereof forming a smooth sliding engagement with the portion of the hand between knuckles of the index finger and thumb facilitating smooth longitudinal reciprocation of the pen.

2. A ballpoint pen comprising an elongate, one-piece plastic body containing an elongate writing cartridge extending along a substantially central location thereof and, a plastic cap, the body being thin, and substantially rigid, having front, writing and rear longitudinal ends joined by respective, rearward diverging opposite side edges which diverge for a majority of an entire length of the body so as to provide a broad, flat, blade-like, hand engaging rear portion and the body tapering in thickness as it extends outward to opposite side and rear edges forming a narrow, peripheral insertion edge, the pen having an overall length, with the cap assembled, which is substantially equal to a conventional credit card, enabling the pen to fit snugly in a credit card receiving pocket of a pocket book, the rear end being straight and the cap being rectangular so that when the cap is assembled on the front end, opposite ends of the pen have straight edges which extend substantially perpendicularly to a longitudinal axis of the body, the side edges being straight for a majority of their lengths and being equidistant from the longitudinal axis at the front end, one side edge having a greater divergence than the other side edge and curving gently inward to join the rear end to provide a lateral supporting and guiding lobe so that, with one pen grip, the lobe rests inclined to the vertical on a side of an index finger knuckle providing a smooth supporting control surface, and in an alternative pen grip, the lobe is substantially vertical with the curving edge thereof forming a smooth sliding engagement with the portion of the hand between knuckles of the index finger and thumb facilitating smooth longitudinal reciprocation of the pen.

3. A ballpoint pen comprising an elongate body molded in one-piece of plastic material containing an elongate writing cartridge with an ink tube connected to a ball point, and a plastic cap, the body being thin, elongate and substantially rigid, having front, writing and rear ends joined by respective, rearward diverging, opposite side edges which diverge for a majority of an entire length of the body so as to provide a broad, flat, blade-like, hand engaging rear portion and the body tapering in thickness as it extends outward to opposite side and rear edges forming a narrow, peripheral insertion edge, an ink tube receiving bore extending rearward from the front end, along a substantially central longitudinal axis, to a location adjacent and spaced from the rear end, and the rear end being straight and the cap being rectangular, so that when the cap is assembled on the front end, opposite ends of the pen have straight edges which extend substantially perpendicularly to a longitudinal axis of the body, the pen having an overall length which is substantially equal to a conventional credit card enabling the pen to fit snugly in a credit card receiving pocket of a pocket book; the side edges being straight for a majority of their lengths and equidistant from the longitudinal axis at the front end, one side edge having a greater divergence from the axis than the other side edge and curving gently inward to join the rear end to provide a lateral supporting and guiding lobe so that, with one pen grip, the lobe rests inclined to the vertical on a side of an index finger knuckle providing a smooth supporting control surface, and in an alternative pen grip, the lobe is substantially vertical with the curving edge thereof forming a smooth sliding engagement with the portion of the hand between knuckles of the index finger and thumb facilitating smooth longitudinal reciprocation of the pen.

* * * * *